US006120228A

United States Patent [19]

Exline

[11] Patent Number: 6,120,228

[45] **Date of Patent: *Sep. 19, 2000**

[54] WALLET SIZE POCKETED BOOKLET

[75] Inventor: Christopher P. Exline, Chagrin Falls, Ohio

[73] Assignee: William Exline, Inc., Cleveland, Ohio

[ * ] Notice: This patent is subject to a terminal disclaimer.

[21] Appl. No.: 09/354,349

[22] Filed: Jul. 14, 1999

[51] Int. Cl.[7] ..... B42C 9/00

[52] U.S. Cl. ..... 412/2; 283/31; 283/34; 283/36; 283/61; 283/65; 283/904; 281/3.1; 281/5; 281/15.1; 281/31; 462/64; 462/65

[58] Field of Search ..... 283/65, 904, 31, 283/61, 34, 36, 56, 3; 462/64, 65; 281/3.1, 5, 31, 15.1, 29, 38, 37; 412/2

[56] References Cited

U.S. PATENT DOCUMENTS

| | | | |
|---|---|---|---|
| 286,650 | 10/1883 | Talcott . | |
| 807,648 | 12/1905 | Wiggins . | |
| 1,912,710 | 6/1933 | Kennedy . | |
| 2,294,796 | 9/1942 | Moulder | 18/59 |
| 2,634,777 | 4/1953 | Berger | 150/59 |
| 2,718,911 | 9/1955 | Solomon | 150/39 |
| 2,722,369 | 11/1955 | Reuter | 229/69 |
| 2,767,756 | 10/1956 | Niles | 150/39 |
| 3,172,687 | 3/1965 | Lawrence | 281/31 |
| 3,201,146 | 8/1965 | Tilton, Jr. | 281/31 |
| 3,310,321 | 3/1967 | Freund | 281/31 |
| 3,360,027 | 12/1967 | Price | 150/39 |
| 3,433,279 | 3/1969 | Seamon | 150/39 |
| 3,526,567 | 9/1970 | Macone | 161/147 |
| 3,537,728 | 11/1970 | Reese | 281/31 |
| 4,125,190 | 11/1978 | Davie, Jr. et al. | 206/532 |
| 4,216,979 | 8/1980 | Janik | 283/58 |
| 4,320,868 | 3/1982 | Petersson | 229/75 |
| 4,492,390 | 1/1985 | Jacobs et al. | 281/31 |
| 4,520,958 | 6/1985 | Jones et al. | 229/72 |
| 4,621,729 | 11/1986 | Jackson | 206/37 |
| 4,824,142 | 4/1989 | Dossche | 282/11.5 |
| 5,143,405 | 9/1992 | Daneshvar | 281/31 |
| 5,156,898 | 10/1992 | McDonald | 428/100 |
| 5,256,254 | 10/1993 | Pease et al. | 162/199 |
| 5,362,103 | 11/1994 | Bromberg | 281/29 |
| 5,421,620 | 6/1995 | Sauerwine | 283/116 |
| 5,431,449 | 7/1995 | Arimoto et al. | 281/31 |
| 5,487,566 | 1/1996 | Hedge, Jr. | 283/56 |
| 5,595,401 | 1/1997 | Exline et al. | 281/2 |
| 5,648,143 | 7/1997 | Mehta et al. | 428/137 |
| 5,800,659 | 9/1998 | Exline et al. | 156/250 |
| 5,913,539 | 6/1999 | Exline et al. | 281/2 |

*Primary Examiner*—Willmon Fridie, Jr.
*Assistant Examiner*—Daniel Phan
*Attorney, Agent, or Firm*—Rhodes & Mason, P.L.L.C.

[57] ABSTRACT

A wallet size pocketed booklet which has been adapted to hold a card having the dimensions of a conventional credit card, and is particularly designed to be carried in the credit card compartment of a wallet or similar size compartment holder. The use of a resin emulsion adhesive, a vinyl acetate ethylene copolymer emulsion, in the pocketed booklet makes it possible to create a properly formed pocket closed on three sides for holding and protecting the card.

5 Claims, 3 Drawing Sheets

WALLET SIZE POCKETED BOOKLET

BACKGROUND OF THE INVENTION (1) Field of the Invention

The present invention relates generally to an article designed to hold and protect identification, credit, debit, and other smart cards, and any information encoded on a magnetic stripe or microchip. More particularly, the present invention relates to a wallet size pocketed booklet which has been constructed to fit within the credit card compartment of a wallet or similar type cardholder.

(2) Description of the Prior Art

Various booklets or folders having card holder pockets and a place to record information or transactions are currently in use. For example, U.S. Pat. No. 5,143,405 (Daneshvar) discloses a booklet for collecting and presenting personal medical information. Although the booklets include pockets formed in the covers of the booklets, the disclosure provides that the pockets may be used to hold additional papers containing medical information. The suggested size of the booklet is approximately 4"×6½", and by size alone, would not conveniently fit into the user's wallet. Further, there is no indicated use of the pockets for holding identification and credit cards.

U.S. Pat. No. 4,621,729 (Jackson) discloses a patient medical information and education container which may be wallet size. Although a pocket is provided which serves to hold a plurality of cards or the like, the user must open a plurality of panels of the container to retrieve a card from the pocket.

U.S. Pat. No. 2,767,756 (Niles) discloses a foldable unit plastic card holder designed to hold a number of cards. However, the card holder does not include any pages on which to record transactions or maintain record-keeping.

U.S. Pat. No. 3,360,027 (Price) discloses a ticket and money holder provided with openings with arcuate lower edges through which tickets and the like may be inserted into and removed from the holder. The holder includes an outer sheet which is stitched to a filler.

Standard size pocketed booklets are also available, for example, savings and passbooks. However, these booklets are too cumbersome in size to fit within the compartments of a wallet. Moreover, attempts to produce wallet size booklets have been unsuccessful because a sufficient area does not remain to obtain a strong glue bond. Additionally, a booklet that has multiple pockets would be preferred for capacity and versatility.

Applicant's previous U.S. Pat. No. 5,595,401 initially addressed this situation in one manner. In the approach described in the previous patent, the booklet is made with smaller than conventional dimensions so as to fit within the credit card compartment of a wallet. Yet the booklet must be large enough to receive and hold conventional credit cards. To accomplish this, a narrow L-shaped glue strip with a special adhesive was designed to adequately maintain the pocket configuration. While this approach is satisfactory for booklets which are folded and attached along one of the longer sides, it is not well adapted for the type of booklets which are folded and attached along one of the shorter sides. It is also difficult to provide a card pocket in both the front and rear cover.

SUMMARY OF THE INVENTION

Accordingly, the present invention addresses the problem from the standpoint of providing credit card pockets in booklets attached along one of the shorter sides. In this respect, the pocketed booklet includes: (a) a cover having a fold which divides the cover into a front cover panel and a rear cover panel; (b) a plurality of leaves attached at the fold, the leaves forming pages; (c) two opposing glue strips extended along the two parallel edges of the inner surface of the cover that are perpendicular to the fold; and (d) at least one pocket formed by a first leaf (fly leaf) sealed to the inner surface of the cover and cut narrower along opposing sides than the cover to form exposed glue strips, a second leaf sealed along two edges to the exposed glue strips on the cover with a third edge at the fold, and a fourth edge remaining open for receiving a credit or information card.

The pocketed booklet may include a credit card pocket behind the front cover, rear cover, or both. While the preferred embodiment will show a pocket in both front and rear covers, it should be understood that only one pocket may be present.

Other aspects of the present invention will become apparent to those skilled in the art after a reading of the following description of the preferred embodiment when considered with the drawings.

DESCRIPTION OF THE PREFERRED EMBODIMENTS

Figure 1:
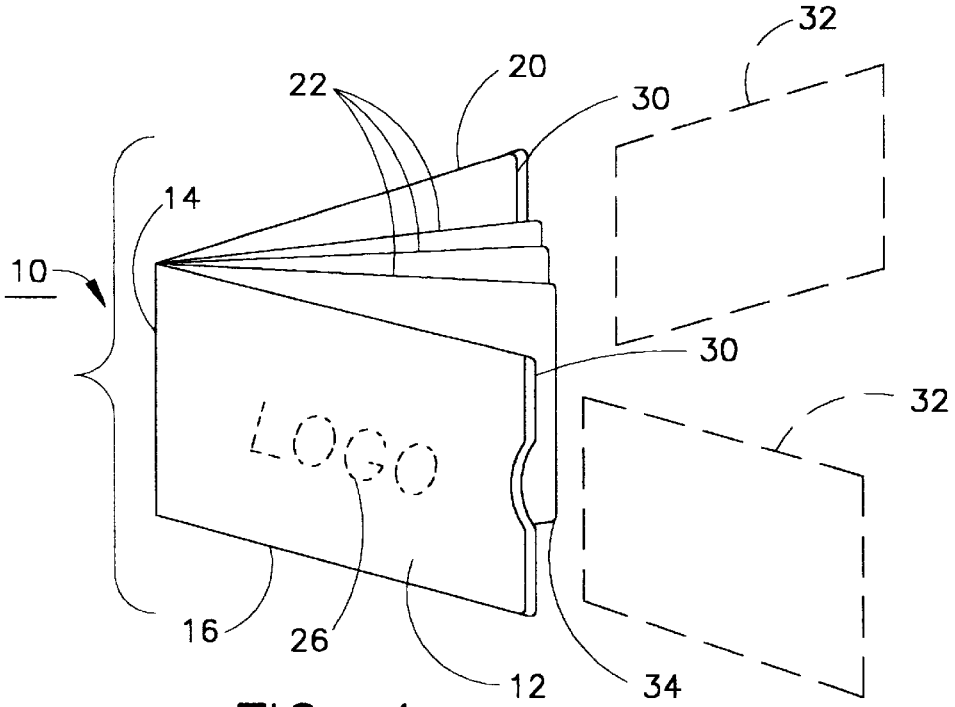
FIG. 1 is a perspective view of a wallet size pocketed booklet constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 4:
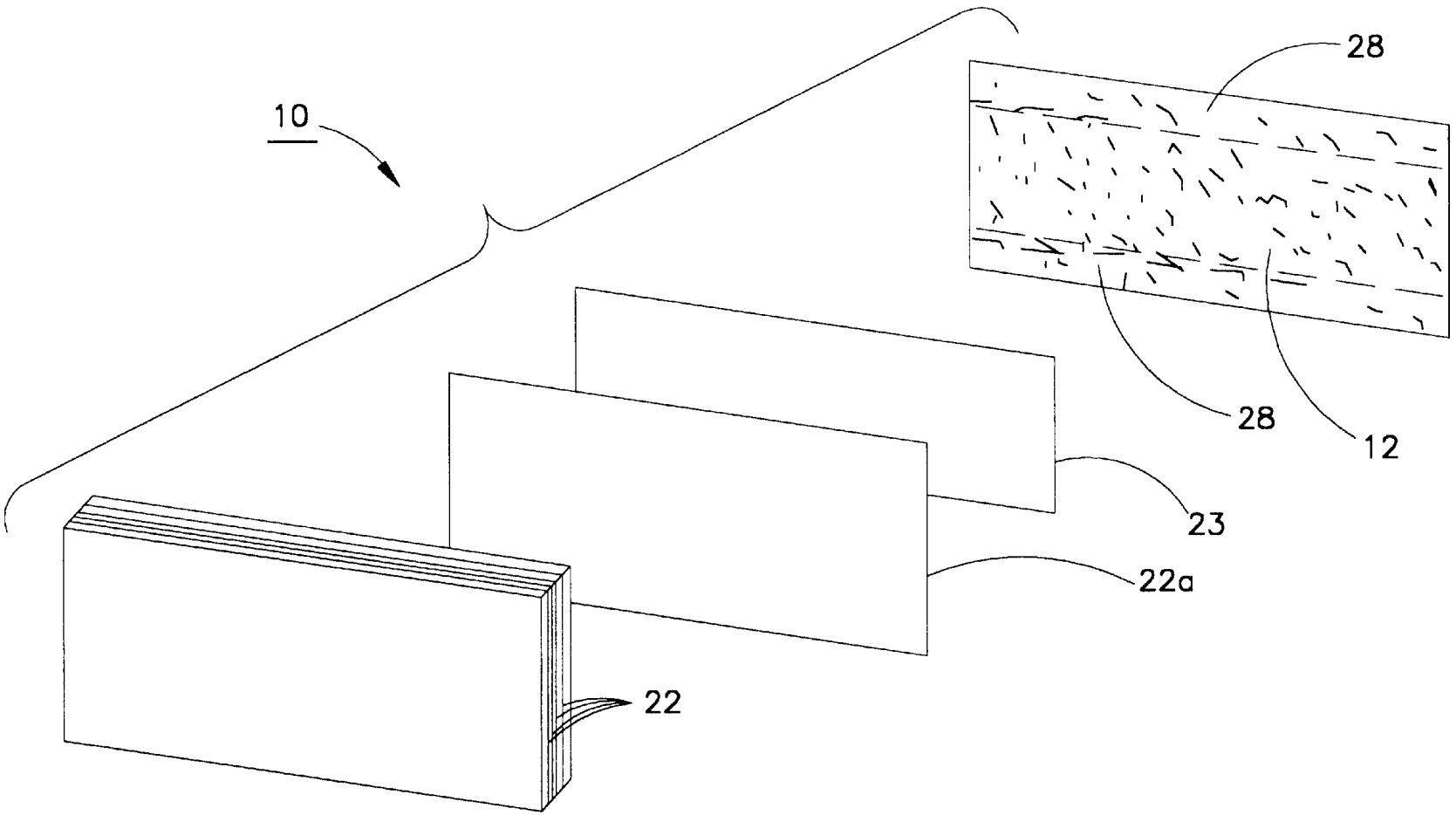
FIG. 4 is an exploded perspective view illustrating the components of the booklet.

Referring now to the drawings in general and FIG. 1 in particular, it will be understood that the illustrations are for the purpose of describing a preferred embodiment of the invention and are not intended to limit the invention thereto. As best seen in FIG. 1, the wallet size booklet, generally designated 10, comprises (a) a cover 12 having a fold 14 along one of the shorter sides which divides the cover into a front cover panel 16 and a rear cover panel 20; (b) a plurality of leaves 22 attached at fold 14, with the leaves forming pages; and (c) two glue strips 28 (shown in FIG. 4) formed along two opposing edges of the inner surface of at least one cover panel. The booklet 10 may include arcuate recesses 24 in the upper edges of the cover 12 and plurality of leaves 22. Cover 12 is preferably formed of a lexide material, and includes indicia 26, for example, a logo, placed on the front cover panel 16 of the booklet. While lexide material is preferred, obviously other materials may be selected for the cover 12. The booklet 10 also includes at least one pocket 30 for holding and protecting a wallet size credit card 32 or comparable size information card.

Pocket 30 of the booklet 10 is formed by flood coating the inner surface of the cover 12 with any appropriate adhesive described in more detail below. A first leaf 23 is cut narrower than the other leaves 22 and affixed to the inner surface of at least one cover 12, leaving glue strips 28 exposed on opposing sides of the inner surface of the cover 12. A second leaf 22A is sealed along two edges to the exposed glue strips 28 on the inner surface of cover 12. Booklet 10 is completed by stitching along fold line 14 and folding along a third edge. A fourth edge remains open for receiving the card 32. A pocket 30 may be formed on the front cover, the rear cover, or both. Leaves 22 preferably are 60-pound offset paper. For added strength, the first or fly leaf preferably is 80-pound offset paper and the second leaf, which forms the pocket, is 100-pound offset paper. While these weights are preferable, other weights may be used.

The glue which is flooded onto the inner surface of cover 12 comprises a resin emulsion adhesive (Evans No. 04053, Evans Adhesive Corp., Columbus, Ohio). The composition of Evans No. 04053 is a vinyl acetate ethylene copolymer emulsion. The adhesive may include other additives, for example, a defoamer. The copolymer emulsion is water-based and contains approximately 45% water, and the vinyl acetate ethylene copolymer emulsion content is approximately >95.0 wt. %. It is contemplated that any comparable adhesive may be used as the glue strip. The thickness of the glue strip ranges between 1/16 inch to about 1/4 inch. The glue strip preferably extends approximately 1/8 inch from the opposed side edges of the inner surface of cover 12.

Figure 2:
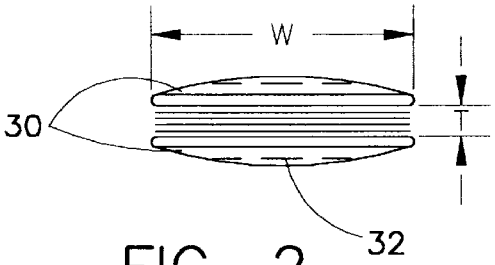
FIG. 2 is an end view of the booklet.
Figure 3:
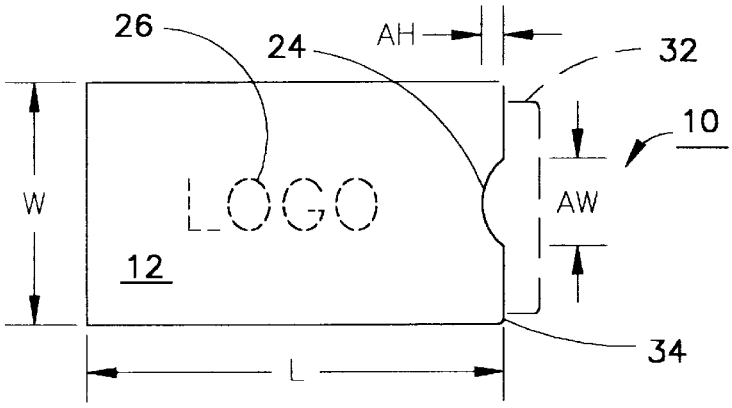
FIG. 3 is a plan view of the booklet with the card partially inserted.

As shown in FIG. 3, the booklet 10 has upper and lower rounded edges 34 opposite the fold 14. Rounded edges 34 are between about 1/8 inch to 3/8 inch in diameter, with a 2 5/8 preferred diameter of 1/4 inch. The width W of booklet 10 ranges between approximately 2 3/8 inches to about 2 5/8 inches, with a preferred width of 2 1/2 inches. The length L of booklet 10 actually ranges between about 3 5/16 inches to about 3 5/8 inches, with a preferred length of 3 1/2 inches. A larger respective length is preferred to facilitate recordation of transactions by allowing a more convenient record-keeping area. For example, the leaves 22 may be pre-printed with a transaction register similar to a standard checkbook register. As shown in FIG. 2, the thickness T of booklet 10 ranges between about 1/16 inch to about 3/16 inch with a preferred thickness of 1/8 inch.

Again referring to FIG. 3, the arcuate recesses 24 have a width AW ranging between approximately 7/8 inch and 1 3/4 inches, with a preferred width of 1 1/2 inches. The depth AH of recess 24 ranges between 3/16 inch and 7/8 inch, with a preferred depth of 11/16 inch. The preferred radius for the arcuate recess is approximately 1/2 inch. The arcuate recess facilitates the insertion and removal of card 32 from pocket 30.

Figure 5:
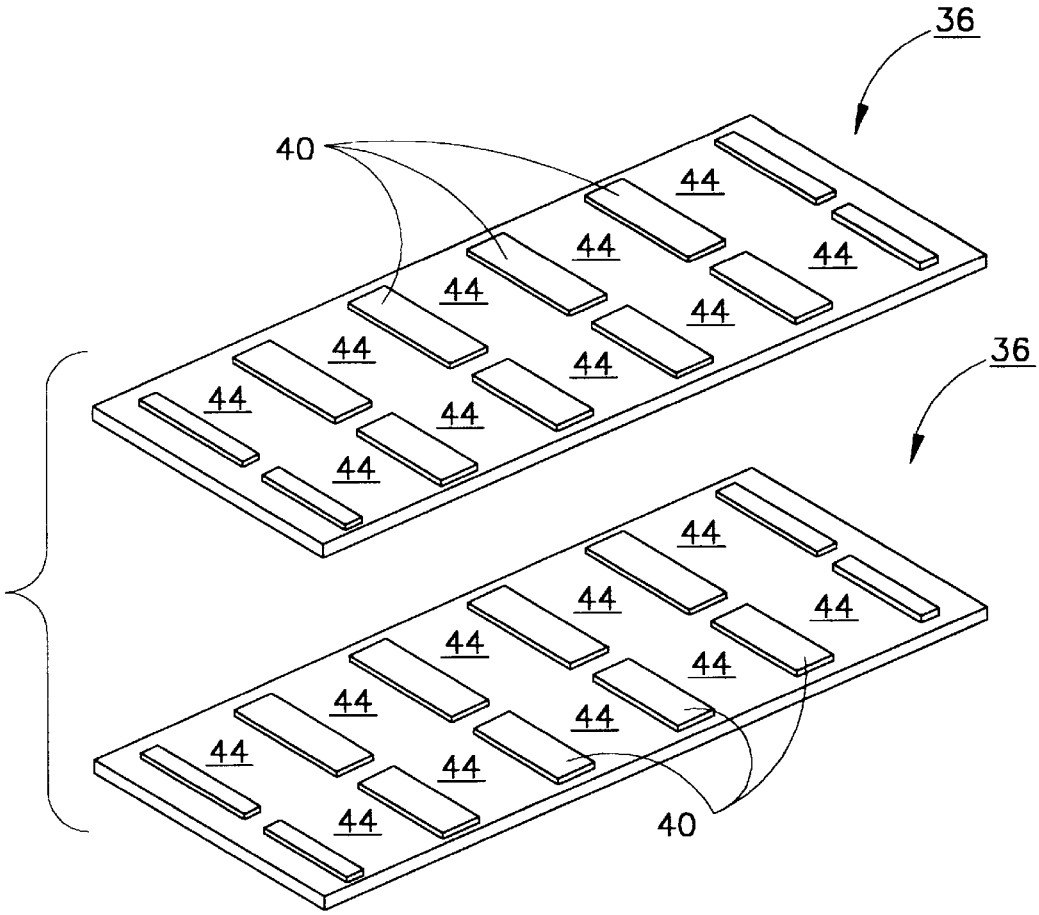
FIG. 5 is a perspective view of the upper and lower dies used to press the cover and pages together; the upper die is inverted for illustrative purposes.
Figure 6:
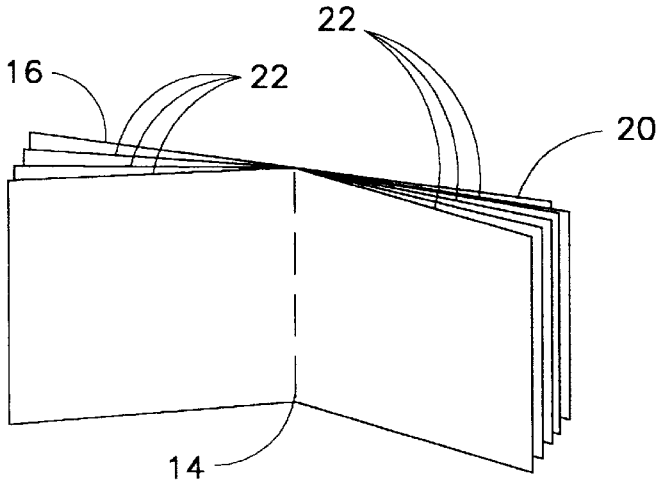
FIG. 6 is a perspective view of the completed booklet.

In producing booklet 10 in accordance with the present invention, any appropriate method may be used. A preferred method involves forming five (5) booklets simultaneously using dies 36 as shown in FIG. 5.

A first (fly) sheet of 80-pound offset paper, as described above, is die cut to remove sections of the first sheet that substantially correspond to the raised strips 40 of the dies 36. Then, a second sheet of 100-pound offset paper is die cut to provide arcuate recesses 24. The first and second sheets are gathered into a stack with a plurality of additional 60-pound offset sheets and collated using the outer edges to align the stack.

The collated stack is then sewn transversely to form the fold line 14. Thereafter, at least one of the inside surface of the front and rear cover panels 16, 20 is flooded with adhesive, as described above. Then, the stack, the cover and the dies are placed in an air-powered vise and squeezed together in order to set the adhesive between the first leaf 23 and the cover 12. Then, the stack, cover, and dies are squeezed to set the adhesive strips between the second leaf 22A and the cover 12.

Each time, the vise is squeezed under approximately 2800 lbs/in$^2$ of pressure for a sufficient amount of time in which to properly seal the adhesive. The pressure may range between about 2000 and 4000 lbs/in$^2$. In a preferred embodiment, the vise may be squeezed between about 30 seconds and about one minute, respectively. The dies 36 function by applying pressure around the outer edges of the leaves, and help to seal the adhesive on the cover 12 of booklet 10. As a result, a pocket 30 is created which is formed by sealing the first leaf and then part of the second leaf to the inner surface of cover 12 using the glue strips 28.

Thus, the first leaf 23 is completely adhered to the inner surface of cover 12, leaving two parallel and opposing glue strips 28 exposed along the edges of the inner surface of cover 12. The second leaf 22A then is adhered by glue strips 28 that remain exposed on the inner surface of cover 12, thereby forming a pocket 30 with a third edge attached at the sew line and a fourth edge remaining open for receiving card 32.

The joined booklets are then folded about the sew line, die cut transversely for length L and width W as well as for rounded edges 34, and separated into five separate booklets.

Although not preferred, entire booklet 10 may be die cut with arcuate recess 24 rather than only cutting the second leaf.

Each die 36 includes raised strips 40 to form a plurality of cavities 44. The inner strips are approximately 5/8 inch wide and 3 1/2 inches long. The outer strips are approximately 5/16 inch wide. Each cavity 44 is approximately 2 3/16 inches wide. A 1/4 inch gap is provided between upper and lower strips for the sew line.

The preferred dimensions for each die 36 is approximately 7 5/8 inches by 16 9/16 inches to accommodate up to five books in an upstate position. The main body of each die is preferably approximately 1/4 inch thick with raised strips 40 extending approximately 0.032 inch above the surface.

Certain modifications and improvements will occur to those skilled in the art upon a reading of the foregoing description. By way of example, it is contemplated that the booklet of the present invention can be modified for use in a variety of industries including but not limited to financial institutions, telecommunications, healthcare, information security, travel and hospitality and prepaid vending. The booklet may, thus, be customized to hold information about a particular organization and its services, programs, etc.

It should be understood that all such modifications and improvements have been deleted herein for the sake of conciseness and readability, but are properly within the scope of the following claims.

We claim:

1. A wallet size pocketed booklet comprising:

(a) a cover having a fold which divides the cover into a front cover panel and a rear cover panel;

(b) a plurality of leaves attached at the fold, the leaves forming pages;

(c) two parallel and opposing glue strips extended along two opposite edges of the inner surface of at least one of the front and rear cover panels;

(d) at least one pocket formed by a first leaf being sealed to the inner surface of the cover and cut narrower than the cover, and a second leaf being sealed along two edges to the glue strips with a third edge attached at the fold and a fourth edge remaining open; and (e) wherein the pocketed booklet is of a suitable size and configuration large enough to retain a conventional size credit card and yet small enough to fit within the conventional card compartments of a wallet.

2. The wallet size pocketed booklet of claim 1, wherein the pocketed booklet has a height dimension of approximately 2⅜ inches to about 2⅝ inches and a width dimension ranging between about 3 5/16 inches to about 3⅝ inches.

3. The wallet size pocketed booklet of claim 2, wherein the dimensions of the pocketed booklet are 2½ to 3½ inches.

4. The wallet size pocketed booklet of claim 1, wherein the glue strips preferably extend approximately ⅛ inch from the opposed side edges of the inner surface of the cover.

5. The wallet size pocketed booklet of claim 1, wherein one pocket is formed on the inner surface of the front cover panel and another pocket is formed on the inner surface of the rear cover panel.

* * * * *